US011374314B1

(12) United States Patent
Vincenzi

(10) Patent No.: US 11,374,314 B1
(45) Date of Patent: Jun. 28, 2022

(54) RECTANGULAR MODULE ARRANGEMENT FOR PHASED ARRAY ANTENNA CALIBRATION

(71) Applicant: Amazon Technologies, Inc., Seattle, WA (US)

(72) Inventor: Giancarlo Vincenzi, Bellevue, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/827,489

(22) Filed: Mar. 23, 2020

(51) Int. Cl.

| | |
|---|---|
| ***H01Q 15/02*** | (2006.01) |
| ***H01Q 3/26*** | (2006.01) |
| ***H01Q 23/00*** | (2006.01) |
| ***H01Q 9/04*** | (2006.01) |
| ***H01Q 21/06*** | (2006.01) |

(52) U.S. Cl.
CPC ..... *H01Q 3/2658* (2013.01); *H01Q 9/0421* (2013.01); *H01Q 21/065* (2013.01); *H01Q 23/00* (2013.01)

(58) Field of Classification Search
CPC ..... H01Q 21/22; H01Q 3/26; H01Q 21/0025; H01Q 21/061; H01Q 21/08; H01Q 21/062; H01Q 21/065; H01Q 21/26; H01Q 25/02; H01Q 5/40; H01Q 3/2682; H01Q 3/46; H01Q 9/28
USPC ..... 343/714, 751, 800, 893
See application file for complete search history.

(56) References Cited

U.S. PATENT DOCUMENTS

| | | | | |
|---|---|---|---|---|
| 5,262,790 | A * | 11/1993 | Russo | H01Q 21/22 343/700 MS |
| 8,077,109 | B1 * | 12/2011 | Roberts | H01Q 21/08 716/110 |
| 9,013,361 | B1 * | 4/2015 | Lam | H01Q 21/061 343/893 |
| 10,211,532 | B2 * | 2/2019 | Foo | H01Q 21/061 |
| 2004/0263420 | A1 * | 12/2004 | Werner | H01Q 1/38 343/909 |
| 2008/0062062 | A1 * | 3/2008 | Borau | H01Q 5/42 343/844 |
| 2016/0156099 | A1 * | 6/2016 | Kim | H01Q 3/26 342/359 |
| 2017/0207547 | A1 * | 7/2017 | Zhai | H01Q 21/065 |

* cited by examiner

*Primary Examiner* — Linh V Nguyen
(74) *Attorney, Agent, or Firm* — Lowenstein Sandler LLP

(57) ABSTRACT

Technologies directed to module arrangements for phased array antenna are described. One phased array antenna structure includes an antenna module having a first even number of antenna elements and a second even number of antenna elements, each of the second even number of antenna elements being terminated to a load. The second even number is n/2, where n is a positive integer that is equal to or greater than two and is equal to the square root of the first even number. The antenna module includes multiple sub-modules each having a rectangular lattice with $$\frac{n}{2} \times \frac{n}{2} + 1$$

rectangular pattern. The sub-modules form a gap at a center of the antenna module and at least one of a calibration antenna or a fastener is located in the gap.

20 Claims, 13 Drawing Sheets

RECTANGULAR MODULE ARRANGEMENT FOR PHASED ARRAY ANTENNA CALIBRATION

BACKGROUND

A large and growing population of users is enjoying entertainment through the consumption of digital media items, such as music, movies, images, electronic books, and so on. The users employ various electronic devices to consume such media items. Among these electronic devices (referred to herein as endpoint devices, user devices, clients, client devices, or user equipment) are electronic book readers, cellular telephones, Personal Digital Assistants (PDAs), portable media players, tablet computers, netbooks, laptops, and the like. These electronic devices wirelessly communicate with a communications infrastructure to enable the consumption of the digital media items. In order to communicate with other devices wirelessly, these electronic devices include one or more antennas.

BRIEF DESCRIPTION OF DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1A:
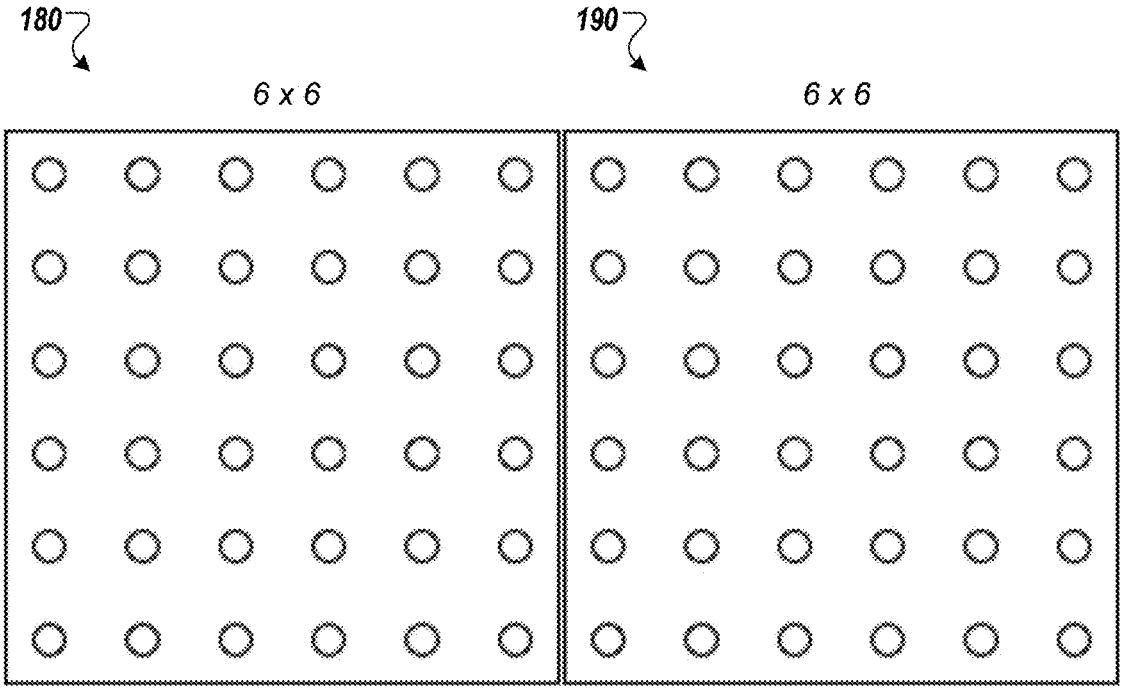
FIG. 1A illustrates two antenna modules with square lattice patterns according to one implementation.

Technologies directed to module arrangements for phased array antennas are described. Described herein are arrangements for antenna modules for applications in large antenna arrays, attachment of the antenna modules to a structure, and their dynamic calibration in any operating environment. A large phased array antenna can include several hundreds of individual antenna elements. For several reasons, including manufacturability and ease of assembly, antenna arrays in the microwave and lower millimeter wave (mmWave) frequency bands are built upon or are supported by Printed Wiring Boards (PWBs) or Printed Circuit Boards (PCBs), where the RF interconnects and possibly also the antenna elements are realized. In general, a PWB is similar to a PCB but without any components installed on it. Tight manufacturing tolerances are needed for microwave antennas, and the larger the board, the more difficult the board is to manufacture while maintaining those tolerances. For some large antenna arrays, a small subset of the antenna array can be manufactured as smaller antenna modules or sub-modules. These antenna modules can include one to tens of regularly spaced elements. The antenna modules can be manufactured using one of several techniques, including Organic substrate PWB and Low Temperature Cofired Ceramic (LTCC) circuit. The subset of elements is referred to as an antenna module or an antenna sub-module or simply a sub-module. The large antenna array can be made up of an array of sub-modules that are attached to another substrate, such as a PWB, for interconnection with a microwave source. Each sub-module thus incorporates an integer number of antenna elements. The modules are often very closely spaced between each other, preventing the insertion of any other component between them.

For proper array operation, a periodic calibration may be necessary to compensate for aging of the electronic components, cumulative damage during lifetime operation, and temperature drift. One possible implementation for such calibration is enabled by the insertion of calibration antennas in proximity to the antenna elements of the large antenna array. The calibration antenna's purpose is to measure the characteristics of the antenna elements around each of them. One problem with conventional solutions is that the supporting PWB has to be physically attached to a support and thus, due to its large dimensions, fasteners in the middle of the PWB are required. The removal of more than one sub-module may become necessary; the total loss of antenna elements equals the number of sub-modules removed times the antenna elements on each module. The performance of the antenna may degrade if this is not considered early enough. Another problem with conventional solutions is that if the antenna modules are too closely spaced, it's very difficult to place calibration antennas between the antenna modules without modifying the geometry of the antenna modules or removing some of the antenna modules.

In addition, one of the main factors in the design of the antenna array is the inter-element spacing. This is typically designed as a compromise between competing figures of merit: number of elements for a given total array aperture and performance at the design scan angle. One practice employed in this compromise is a technique called "Array Thinning," which enables a target active element count being kept while also reducing the inter-element spacing.

Aspects of the present disclosure overcome the deficiencies of conventional antennas by providing an array of rectangular modules (also referred to herein as "sub-modules") that are organized in such a way to create an area on a circuit board (e.g., PWB) where a fastener or a calibration antenna can be disposed while maintaining a target active element count and reducing the inter-element spacing. The calibration antenna can be coupled to a second radio. Aspects of the present disclosure can organize the antenna array into an array of rectangular modules assembled in groups of four, each module rotated 90 degrees (90°), with respect to the previous one, around the normal to a plane of the antenna array, resulting in a gap between the rectangular modules. The gap can be used for a fastener or a calibration antenna. Aspects of the present disclosure can reduce the inter-element spacing by a factor of $$\frac{n+1}{n}$$

from an inter-element spacing of an antenna module having a square lattice with a n×n square pattern. That is, the antenna module can have a first inter-element spacing between elements that is less than a second inter-element spacing of a square lattice with a n×n square pattern. The first inter-element spacing is reduced by a factor of $$\frac{n+1}{n}$$

from the second inter-element spacing. Aspects of the present disclosure can group antenna elements into rectangular antenna modules. The rectangular antenna modules can be a rectangular lattice with $$\frac{n}{2}\times\frac{n}{2}+1$$

rectangular pattern. A number of the antenna elements of each rectangular antenna module can be terminated with a matched load. The antenna elements to be terminated can be chosen randomly or algorithmically by simulation of the entire array performance within the area of a first rectangular module (e.g., $$\frac{n}{2}\times\frac{n}{2}+1).$$

One phased array antenna structure includes an antenna module having a first even number of antenna elements and a second even number of antenna elements. Each antenna element of the second even number of antenna elements is terminated to a matched load. The second even number is n/2, where n is a positive integer that is equal to or greater than two and is equal to the square root of the first even number. The antenna module includes multiple sub-modules, each having a rectangular lattice with $$\frac{n}{2}\times\frac{n}{2}+1$$

rectangular pattern. The sub-modules form a gap at a center of the antenna module, and at least one of a calibration antenna or a fastener is located in the gap. The calibration antenna can be coupled to a second radio.

Aspects of the present disclosure can use rectangular modules that are identical to facilitate manufacturing, assembly, and part management. An antenna module can include four antenna sub-modules that are assembled as a group of four sub-modules by rotating 90° each new module around normal to the phased array passing through the center of the group, leaving a gap in the pattern at a center of the group. With this assembly pattern in mind, it is possible to terminate only one element for each column and row and select algorithmically the thinned elements so that all columns and rows in a group have the same amount of active elements, except a center row and a center column, obtaining the same amount of active elements as in the original n×n square module. Aspects of the present disclosure can place a fastener, a calibration antenna, or a combined antenna-fastener structure, in the gap in the module pattern. As a result, the phased array antenna can be built with the antenna modules with a systematic, scalable, and easy to manufacture approach to array thinning. Also, by creating the gap in the pattern, the antenna modules can be attached to a support structure (e.g., circuit board) of the phased array antenna or have a necessary space for a calibration antenna that does not compromise performance of the antenna array. An example of array thinning is described below with respect to FIGS. 1A-1E.

FIG. 1A illustrates two antenna modules with square lattice patterns according to one implementation. A first antenna module 180 includes 36 antenna elements, organized as a 6×6 square lattice pattern. A second antenna module 190 includes 36 antenna elements, organized as a second 6×6 square lattice pattern. The first antenna module 180 and the second antenna module 190 are assembled and positioned to be adjacent to one another. For example, the first antenna module 180 and the second antenna module 190 can be coupled to a support structure, such as a circuit board. An antenna array can include these two antenna modules or could include even more antenna modules. In this example, there are 36 active elements per module. As noted above, the antenna modules being positioned side by side does not provide space for fasteners or calibration antennas.

Figure 1B:
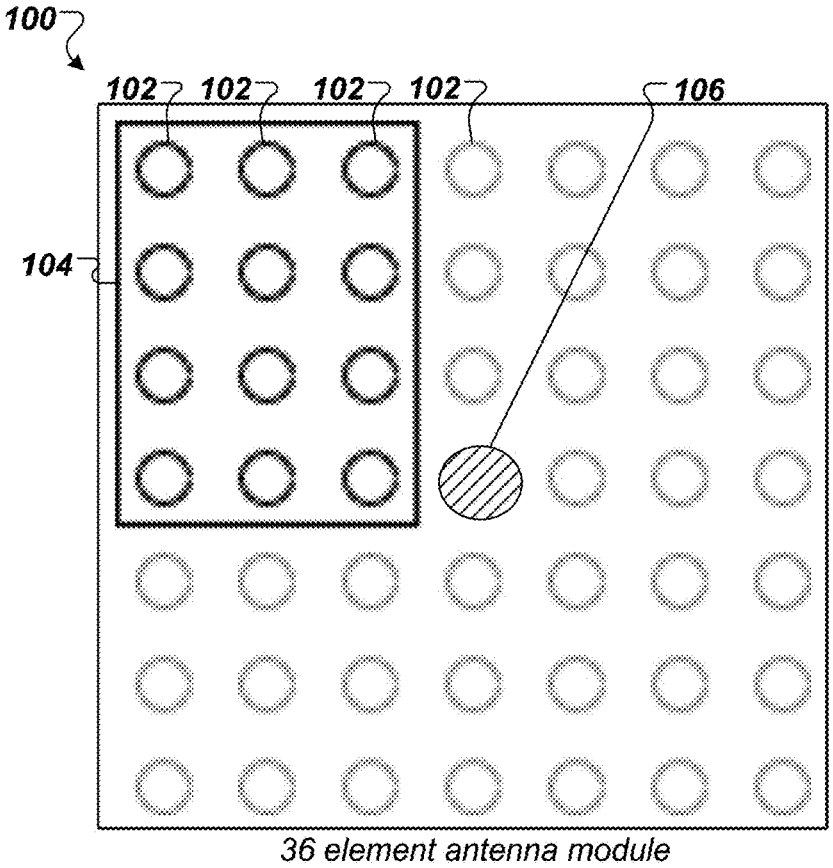
FIG. 1B illustrates an antenna module with antenna elements grouped to form a gap in a square lattice pattern according to one embodiment.

The embodiments described herein allow array thinning that accommodates a fastener, a calibration antenna, or a combined fastener-antenna structure while maintaining a same number of active elements per module, such as illustrated in the example of FIG. 1B.

FIG. 1B illustrates an antenna module 100 with antenna elements 102 grouped to form a gap 106 in a square lattice pattern according to one embodiment. The antenna module 100 includes multiple antenna elements, including a set of active antenna elements and a set of terminated elements. A terminated element is an antenna element that is terminated to a matched load. An active antenna element is an antenna element that is coupled to a signal source, such as a radio or a microwave source. As compared to FIG. 1A, the antenna module 100 also includes 36 active antenna elements. The following describes multiple steps of how to organize antenna elements of the antenna module to reduce inter-element spacing while maintaining a same number of active elements as compared to a n×n square lattice pattern, such as in the first antenna module 180. That is, the organization of antenna elements using this technique can think the square lattice pattern of the first antenna module 180 to a square lattice structure with the gap 106 that accommodates a calibration antenna, a fastener, or a combined fastener-antenna structure.

Starting with an antenna module with n×n number of antenna elements (e.g., 36) organized in a square lattice, where n is an even number, identify an n/2×n/2+1 number of elements 102 in the antenna module 100 can be identified and reorganized to reduce inter-element spacing. In this embodiment, the inter-element spacing in the antenna module 100 can be reduced by a factor of (n+1)/n, yet the resulting module size (e.g., count of active antenna elements) remains the same (e.g., 36). Next, the antenna elements 102 can be grouped into multiple groups, such as illustrated by a first group 104 in FIG. 1B. The first group 104 can be the antenna elements 102 that are located at a first corner of the square lattice. The first group 104 includes 12 antenna elements. Within the group, a second number of these antenna elements are terminated with a matched load. In one example, the first group 104 includes 3 terminated elements. In other antenna modules, a number of n/2 antenna elements are terminated with the matched load. Which antenna elements 102 to terminate can be chosen randomly or algorithmically by simulation of the entire array performance within the first n/2×n/2+1 area of the antenna module 100. The group 104 can be an antenna module that is part of the antenna module 100, which may be part of a large phased array antenna. Alternatively, the group 104 can be a sub-module of the antenna module 100.

In the case of the group 104 being one sub-module of the antenna module 100, each group can be made of similar sub-modules. In some cases, the groups are identical sub-modules that can be manufactured as a single stock keeping unit (SKU). In some cases, even the elements that are terminated in other groups can be the elements at the same locations and the terminated elements in the first group 104. The sub-modules can be all identical to facilitate manufacturing, assembly, and part management. The antenna module 100 can be assembled as four sub-modules, one sub-module per group of antenna elements. One sub-module, corresponding to the first group 104 can be positioned at a first position on a support structure, such as a circuit board. Each additional sub-module is rotated 90° around normal to the support structure for the phased array. The four sub-modules, corresponding to the four groups, form the gap 106 or an opening in an area of material located between the four sub-modules, such as at the center of the four groups. The support structure can include a hole through a fastener can pass through the gap 106 between the four sub-modules and the hole in the support structure to fasten the antenna module 100 to the support structure. With this assembly pattern, it is possible to terminate only one element for each column and row and select the terminated elements as thinned elements algorithmically so that all columns and all rows in a group have the same amount of active elements, excluding a center row and a center column. As a result, the same amount of active elements as the original n×n square lattice can be obtained. As described herein, a fastener, a calibration antenna, or a combined fastener-antenna structure can be located in the gap 106 in the module pattern.

The techniques described above can provide a systematic, scalable, and easy-to-manufacture approach to array thinning antenna elements 102 of the antenna module 100. The gap 106, formed by the groups of antenna elements 102, gives the ability to attach the antenna module 100 to the support structure and/or place calibration antennas in proximity to the antenna elements 102 without compromising its performance. The gap 106 creates the necessary space for the fastener, the calibration antenna, or the combined fastener-antenna structure without compromising its performance. It should be noted that although the antenna elements 102 are illustrated as circles, the circles represent the positions of the various antenna elements 102. The antenna elements 102 can be any type of antenna element, such as a patch antenna element, a slot antenna, a dipole, a monopole, or the like.

Figure 1C:
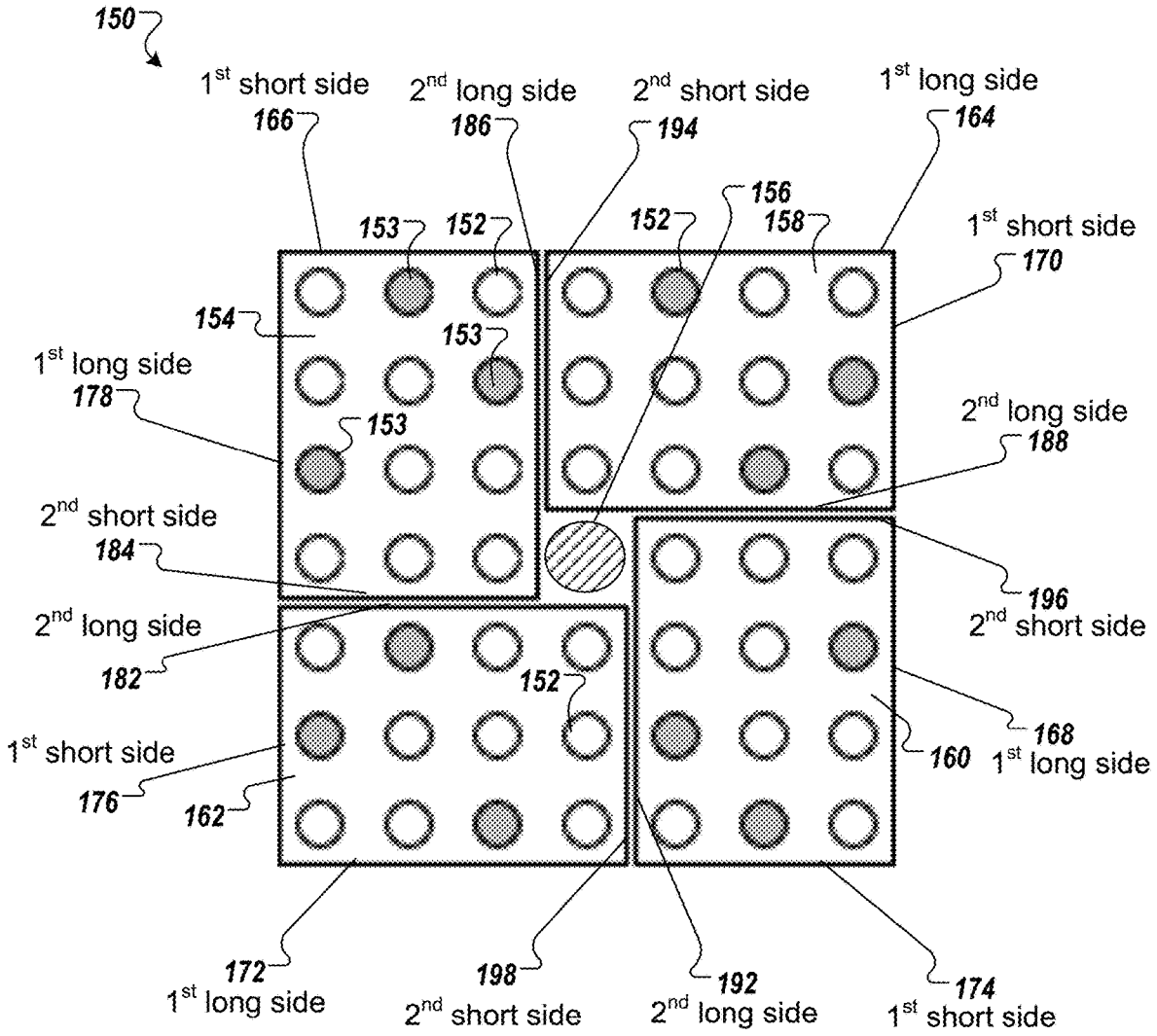
FIG. 1C illustrates an antenna module with four sub-modules and a gap between the four sub-modules according to one embodiment.

FIG. 1C illustrates an antenna module 150 with four sub-modules and a gap 156 between the four sub-modules according to one embodiment. The antenna module 150 includes a first sub-module 154, a second sub-module 158, a third sub-module 160, and a fourth sub-module 162. The first sub-module 154 includes a first set of antenna elements 152. The first sub-module 154 has a rectangle shape. The second sub-module 158 includes a second set of antenna elements 152. The second sub-module 158 has the rectangle shape. The third sub-module 160 includes a third set of antenna elements 152. The third sub-module 160 has the rectangle shape. The fourth sub-module 162 includes a fourth set of antenna elements 152. The fourth sub-module 162 has the rectangle shape. The first sub-module 154 is disposed in a plane and the second sub-module 158 is disposed in the plane and adjacent to the first sub-module 154, the second sub-module 158 being rotated 90 degrees from the first sub-module 154 such that a first long side 164 of the second sub-module 158 is aligned with a first short side 166 of the first sub-module 154. The third sub-module 160 is disposed in the plane and adjacent to the second sub-module 158, the third sub-module 160 being rotated 90 degrees from the second sub-module 158 such that a first long side 168 of the third sub-module 160 is aligned with a first short side 170 of the second sub-module 158. The fourth sub-module 162 is disposed in the plane and adjacent to the third sub-module 160, the fourth sub-module 162 being rotated 90 degrees from the third sub-module 160 such that i) a first long side 172 of the fourth sub-module 162 is aligned with a first short side 174 of the third sub-module 160, ii) a first short side 176 of the fourth sub-module 162 is aligned with a first long side 178 of the first sub-module 154, and iii) a second long side 182 of the fourth sub-module 162 is adjacent to a second short side 184 of the first sub-module 154. The first sub-module 154, the second sub-module 158, the third sub-module 160, and the fourth sub-module 162 form the gap 156 between a portion of a second long side 186 of the first sub-module 154, a portion of a second long side 188 of the second sub-module 158, a portion of a second long side 192 of the of the third sub-module 160, and a portion of the second long side 182 of the fourth sub-module 162. The second long side 186 of the first sub-module 154 is adjacent to a second short side 194 of the second sub-module 158. A second short side 196 of the third sub-module 160 is adjacent to the second long side 188 of the second sub-module 158. A second short side 198 of the fourth sub-module 162 is adjacent to the second long side 192 of the third sub-module 160.

In another embodiment, the first sub-module 154, the second sub-module 158, the third sub-module 160, and the fourth sub-module 162 collectively form a gap between a portion of the second long side of the first antenna module, a portion of a second long side of the second antenna module, a portion of a second long side of the of the third antenna module, and a portion of a second long side of the fourth antenna module.

In one embodiment, the first sub-module 154, the second sub-module 158, the third sub-module 160, and the fourth sub-module 162 are identical modules. In some embodiments, each set of antenna elements 152 in each of the sub-modules is arranged in a grid pattern and the grid pattern includes n/2 antenna elements by n/2+1 antenna elements, where n is a positive, even integer that is equal to or greater than two representing a multiplier of a size of the antenna array. In the depicted embodiment, the grid pattern includes 3×4 antenna elements 152 and 3 antenna elements 153 of the antenna elements are terminated with a matched load. The same 3 antenna elements in the other sub-modules are also terminated in a similar fashion. That is, the pattern of terminated elements 153 and active elements 152 is repeated in each of the sub-modules, even though the sub-modules are rotated about normal to a plane of the antenna array.

In another embodiment, the first sub-module 154, the second sub-module 158, the third sub-module 160, and the fourth sub-module 162 are identical modules and the first set of antenna elements 152 is arranged in a third number of rows and a fourth number of columns, the third number being greater than the fourth number. Only one element (153) in each of the columns is terminated with a matched load and only one of the rows has no elements that are terminated with the matched load. Alternatively, the grid pattern can include different patterns of active antenna elements (152) and terminated elements (153).

In one embodiment, a radio is coupled to an antenna array, including the antenna module 150 (or antenna module 100). The radio can include a baseband processor and radio frequency front-end (RFFE) circuitry. Alternatively, a microwave radio or other signal source can be coupled to the antenna module 150 (or antenna module 100). Each of the four sub-modules can be coupled physically to the support structure and electrically coupled to a communication system, such as RF radio or a microwave radio. The antenna module 150 (or antenna module 100) can be coupled to a circuit board or other types of support structures. That is, the four sub-modules can be secured to a support structure, the support structure having a hole through which a fastener can be disposed to secure the antenna module 150 to the support structure and/or the circuit board, such as illustrated in FIG. 2A.

In one embodiment, there are n/2 terminated elements per antenna module. There are 5 active elements in each row and column, except the middle row and the middle column where there are 6 active elements. The total count of 36 active elements is still maintained.

Figure 2A:
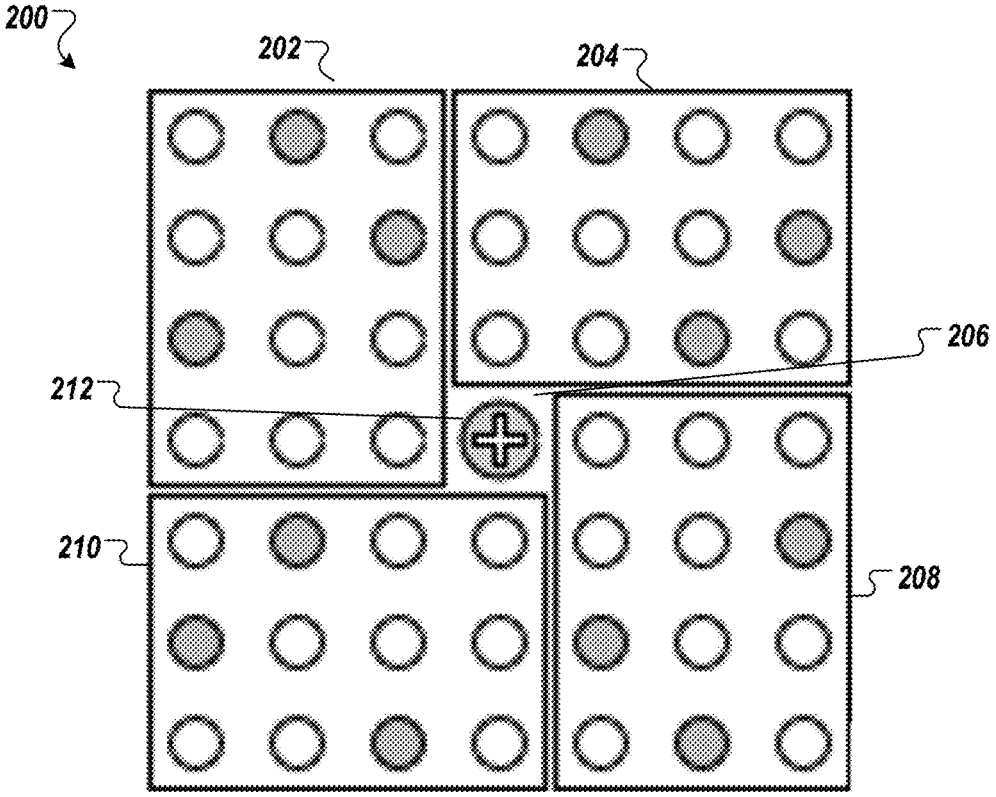
FIG. 2A illustrates an antenna module with four sub-modules and a gap between the four sub-modules to accommodate a fastener according to one embodiment.

FIG. 2A illustrates an antenna module 200 with four sub-modules 202, 204, 208, 210 and a gap 206 between the four sub-modules 202, 204, 208, 210 to accommodate a fastener 212 according to one embodiment. The fastener 212 is located at the gap 206 at a center of the antenna module 200. Alternatively, the support structure can include an area in which a calibration antenna is located within the gap 156, which is formed in between the four sub-modules, such as illustrated in FIG. 2B.

Figure 2B:
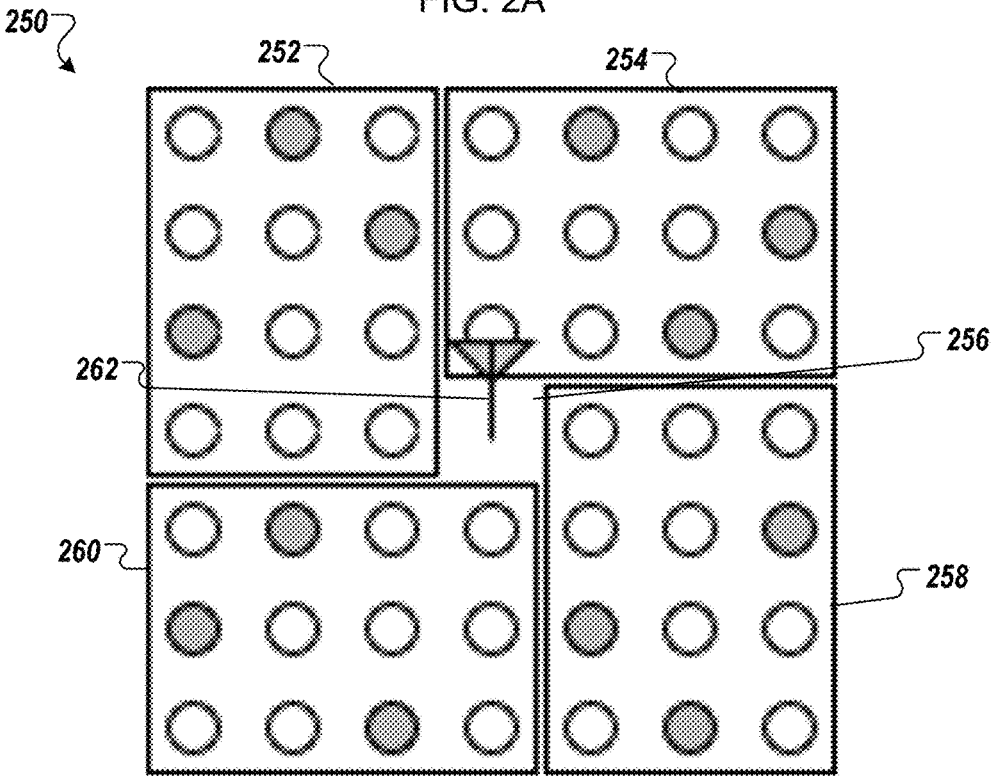
FIG. 2B illustrates an antenna module with four sub-modules and a gap between the four sub-modules to accommodate a calibration antenna according to one embodiment.

FIG. 2B illustrates an antenna module 250 with four sub-modules 252, 254, 258, 260 and a gap 256 between the four sub-modules 252, 254, 258, 260 to accommodate a calibration antenna 262 according to one embodiment. The calibration antenna 262 is located at the gap 256 at a center of the antenna module 250.

Figure 3:
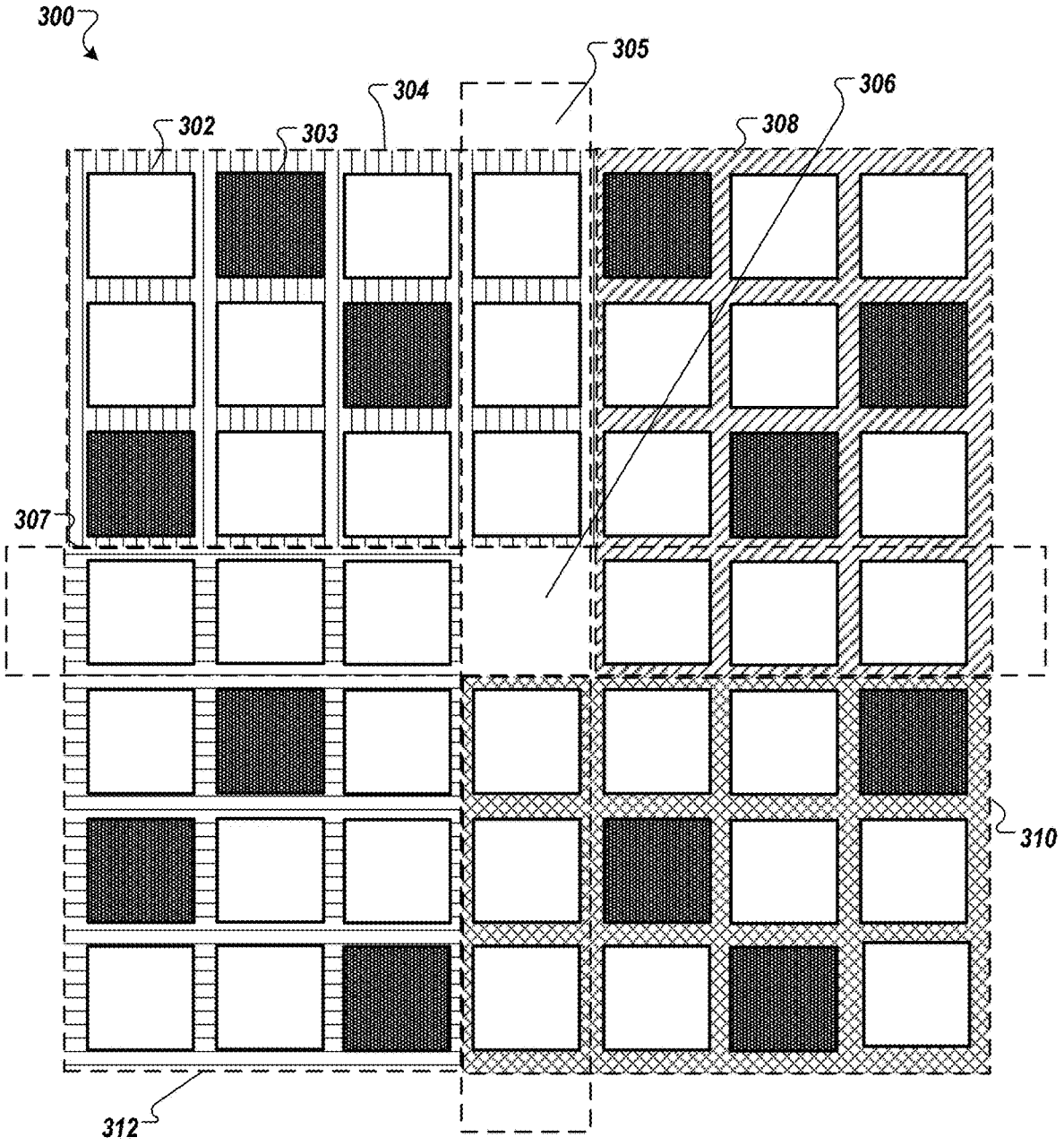
FIG. 3 illustrates a lattice pattern of an antenna module with array thinning according to one embodiment.

FIG. 3 illustrates a lattice pattern of an antenna module 300 with array thinning according to one embodiment. The antenna module 300 includes 48 antenna elements, 36 of which are active elements 302 and 12 of which are terminated elements 303. The antenna elements of the antenna module 300 are organized into 4 groups: a first group 304, a second group 308, a third group 310, and a fourth group 312. The first group 304 can include 12 antenna elements, 9 of which are active element 302 and 3 of which are terminated elements 303. The first group 304 can be a first manufactured part. The second group 308 can include 12 antenna elements, 9 of which are active element 302 and 3 of which are terminated elements 303. The second group 308 can be a second manufactured part. The second manufactured part can be identical to the first manufactured part, even with respect to the pattern of which of the twelve antenna elements are the terminated elements 303. The third group 310 can include 12 antenna elements, 9 of which are active element 302 and 3 of which are terminated elements 303. The third group 310 can be a third manufactured part. The third manufactured part can be identical to the first and manufactured parts, even with respect to the pattern of which of the twelve antenna elements are the terminated elements 303. The fourth group 312 can include 12 antenna elements, 9 of which are active element 302 and 3 of which are terminated elements 303. The fourth group 312 can be a fourth manufactured part. The fourth manufactured part can be identical to the first, second, and third manufactured parts, even with respect to the pattern of which of the twelve antenna elements are the terminated elements 303.

In one embodiment, the first group 304 is a sub-module that is secured to a support structure. The support structure can include a gap 306 through which a fastener can be positioned to secure the support structure to a circuit board. Similarly, the second group 308, the third group 310, and the fourth group 312 can be sub-modules that are secured to the support structure.

In some embodiments, the antenna module 300 has a first even number of antenna elements and a second even number of antenna elements, each of the second even number of antenna elements being terminated to a matched load. In one embodiment, the second even number is n/2, where n is the a positive integer that is equal to or greater than two and is equal to the square root of the first even number. In another embodiment, the antenna module 300 includes a set of sub-modules, each having a rectangular lattice with $$\frac{n}{2} \times \frac{n}{2} + 1$$

rectangular pattern. For example, the first group 304 is a 4×3 rectangular pattern. The second group 308, the third group 310, and the fourth group 312 can be identical to the first group 304. That is, each of the first group 304, the second group 308, the third group 310, and the fourth group 312 is an identical manufactured part (e.g., a single stock keeping unit (SKU). The set of sub-modules form the gap 306 in the square lattice pattern. At least one of a calibration antenna or a fastener can be located in the gap 306 formed between the set of sub-modules. In one embodiment, the antenna module 300 includes an inter-element spacing between antenna elements (302, 303) and the inter-element spacing can be reduced by a factor of $$\frac{n+1}{n}$$

from an inter-element spacing of an antenna module having a square lattice with a n×n square pattern.

In one embodiment, the second group 308 is identical to the first group 304 and is disposed adjacent to the first group 304, but rotated 90° about the gap 306 in the same plane. The third group 310 is identical to the second group 308 and is disposed adjacent to the second group 308, but rotated 90° about the gap 306 in the same plane. The fourth group 312 is identical to the third group 310 and is disposed adjacent to the third group 310, but rotated 90° about the gap 306 in the same plane. In the depicted embodiment, the gap 306 is located at a center of the antenna module 300. In other embodiments, other shapes of sub-modules can be used and the gap can be formed in other locations.

In one embodiment, the first group 304 is a first sub-module with a first set of antenna elements 302 and a rectangle shape. The first sub-module also includes a first set of terminated elements 303. The second group 308 is a second sub-module with a second set of antenna elements 302 and a rectangle shape. The second sub-module also includes a second set of terminated elements 303. The third group 310 is a third sub-module with a third set of antenna elements 302 and a rectangle shape. The third sub-module also includes a third set of terminated elements 303. The fourth group 312 is a fourth sub-module with a fourth set of antenna elements 302 and a rectangle shape. The fourth sub-module also includes a fourth set of terminated elements 303. The first sub-module (first group 304) is disposed in a plane, considered an antenna array plane. The second sub-module (second group 308) is disposed in the plane and adjacent to the first sub-module, the second sub-module being rotated 90 degrees from the first sub-module such that a first long side of the second sub-module is aligned with a first short side of the first sub-module. The third sub-module (third group 310) is disposed in the plane and adjacent to the second sub-module, the third sub-module being rotated 90 degrees from the second sub-module such that a first long side of the third sub-module is aligned with a first short side of the second sub-module. The fourth sub-module (fourth group 312) is disposed in the plane and adjacent to the third sub-module, the fourth sub-module being rotated 90 degrees from the third sub-module such that i) a first long side of the fourth sub-module is aligned with a first short side of the third sub-module, ii) a first short side of the fourth sub-module is aligned with a first long side of the first sub-module, and iii) a second long side of the fourth sub-module is adjacent to a second short side of the first sub-module.

In the depicted embodiment, the first sub-module, the second sub-module, the third sub-module, and the fourth sub-module are identical sub-modules. In the depicted embodiment, the first group 304 of antenna elements is arranged in a grid pattern that includes 3 antenna elements by 4 antenna elements. In another embodiment, the first group 304 of antenna elements is arranged in a grid pattern with n/2 antenna elements by n/2+1 antenna elements, where n is a positive, even integer that is equal to or greater than two representing a multiplier of a size of the antenna module.

In the depicted embodiment, the first group 304 of antenna elements is arranged in 3 rows and four columns. Alternatively, the first group 304 of antenna elements is arranged in 4 rows and three columns. In other embodiment, the first group 304 is arranged in a third number of rows and a fourth number of columns, the third number being greater than the fourth number. In other embodiments, the first group 304 is arranged in a third number of rows and a fourth number of columns, the third number being less than the fourth number. As described herein, some of the antenna elements in the first group 304 are terminated with a matched load (illustrated as terminated elements 303). The elements to be terminated can be selected randomly or systematically. As illustrated in FIG. 3, the terminated elements 302 are selected systematically so that only one element in each of the rows is terminated with the matched load and only one of the columns (labeled 305) has no elements that are terminated with the matched load. Alternatively, when the first group 304 is has 3 columns and four rows, the terminated elements 302 are selected systematically so that only one element in each of the columns is terminated with the matched load and only one of the rows has no elements that are terminated with the matched load. As illustrated in FIG. 3, the second group 308 of antenna elements is arranged in 3 columns and 4 rows (or 4 columns and 3 rows that are rotated 90°). As illustrated in FIG. 3, the terminated elements 302 of the second group 308 are selected systematically so that only one element in each of the columns is terminated with the matched load and only one of the rows (labeled 307) has no elements that are terminated with the matched load. As illustrated in FIG. 3, the third group 310 of antenna elements is arranged in 4 columns and 3 rows (or 3 columns and 4 rows that are rotated 90°). As illustrated in FIG. 3, the terminated elements 302 of the third group 310 are selected systematically so that only one element in each of the rows is terminated with the matched load and only one of the columns (labeled 305) has no elements that are terminated with the matched load. It should be noted that the column of the first group 304 and the column of the third group 310 are part of the same column 305. As illustrated in FIG. 3, the fourth group 312 of antenna elements is arranged in 3 columns and 4 rows (or 4 columns and 3 rows that are rotated 90°). As illustrated in FIG. 3, the terminated elements 302 of the fourth group 312 are selected systematically so that only one element in each of the columns is terminated with the matched load and only one of the rows (labeled 307) has no elements that are terminated with the matched load. It should be noted that the row of the second group 308 and the row of the fourth group 312 are part of the same row 307. The column 305 is the center column in the antenna module 300 that includes the center where the gap 306 is located. Similarly, the row 307 is the center row in the antenna module 300 that includes the center where the gap 306 is located. Alternatively, other patterns of terminated elements 302 and locations of rows or columns that have not terminated elements can vary.

In one embodiment, the gap 306 accommodates placement of a calibration antenna. In another embodiment, the gap 306 accommodates placement of a fastener to secure the antenna module 300 to a support structure. That is, the antenna module 300 can be a circuit board, such as a PCB or a PWB, that is secured to a support structure using the fastener at the gap 306. The support structure can be any structure that is to support the antenna array. In another embodiment, the gap 306 accommodates placement of a combined antenna-fastener, such as the monopole antenna fastener described below with respect to FIGS. 10A-10B.

Figure 4:
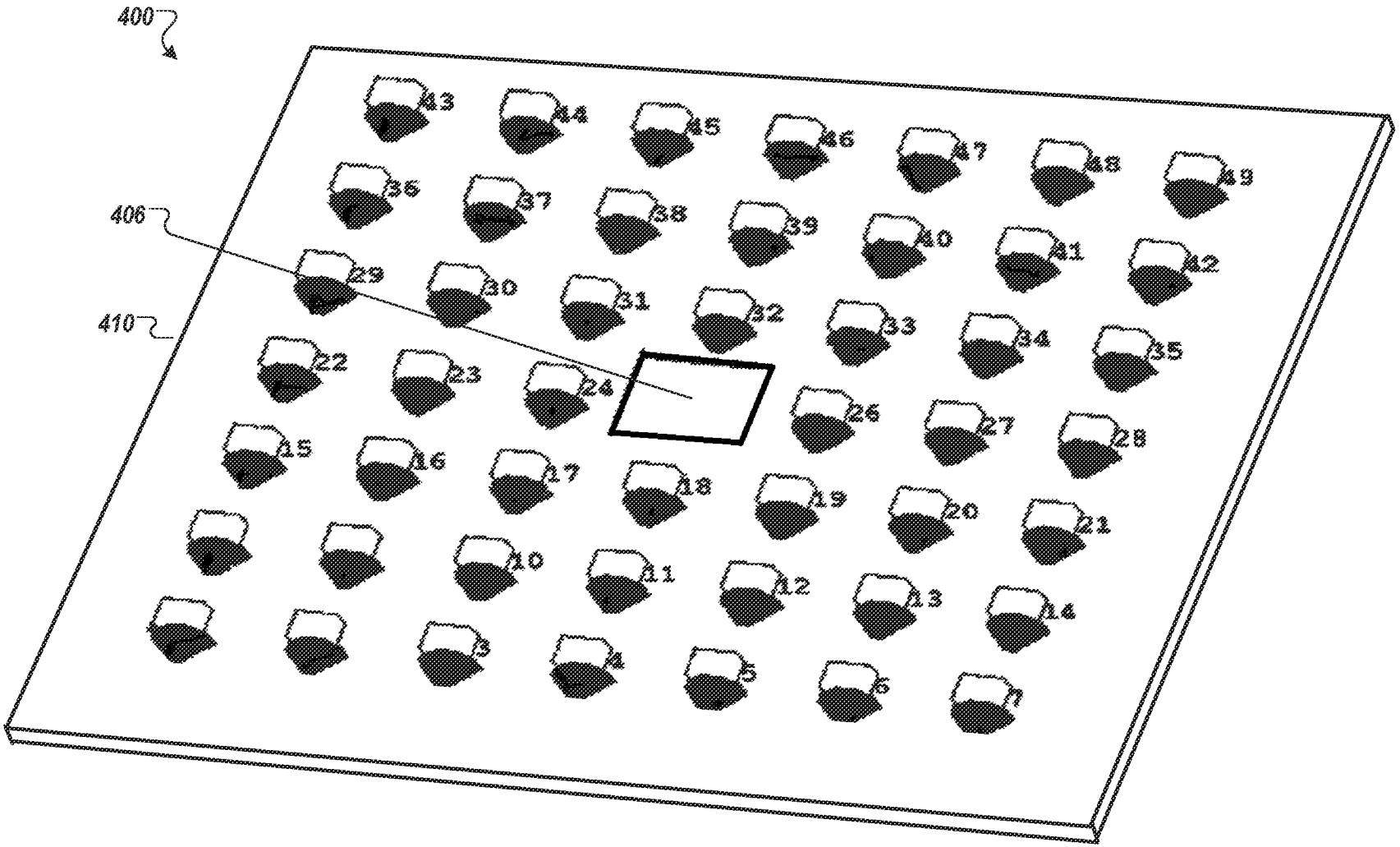
FIG. 4 is an antenna module with a gap in an element pattern for fastening to a circuit board according to one embodiment.

FIG. 4 is an antenna module 400 with a gap 406 in an element pattern for fastening to a circuit board according to one embodiment. The antenna module 400 is a simplified model of a 7×7 antenna elements. The antenna module 400 can have similar number of active elements, 36, as a 6×6 square lattice. By array thinning the antenna module 400, some of the elements are terminated, such as described herein. It should be noted that the antenna elements in antenna module 400 have not be rotated to reflect a rotated sub-module arrangement described above with respect to FIGS. 1C-3 for simplicity of drawings. The sub-modules are secured to a support structure 410. The support structure 410 can include an opening that is aligned with the gap 406 in the element pattern.

Figure 5A:
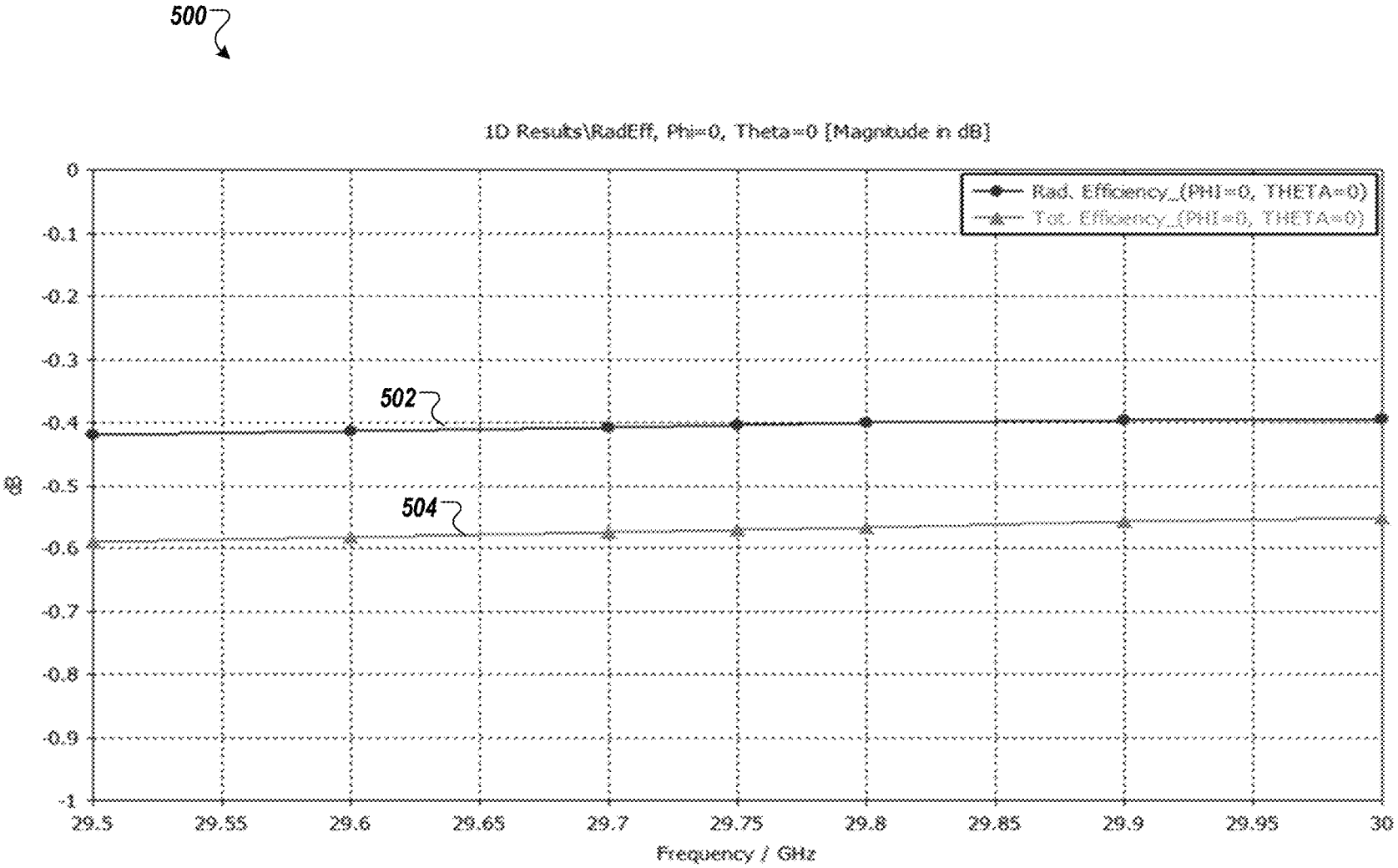
FIG. 5A is a graph of a radiation efficiency and a total efficiency of an antenna module with a rotated sub-module arrangement according to one embodiment.

FIG. 5A is a graph 500 of a radiation efficiency 502 and a total efficiency 504 of an antenna module with a rotated sub-module arrangement according to one embodiment. The graph 500 shows radiation efficiency 502 of the antenna module for a frequency range between 29.5 GHz to 30 GHz. The graph 500 also shows the total efficiency 504 of the antenna module for the frequency range between 29.5 GHz to 30 GHz. The graph 500 illustrates that the antenna module is a viable antenna for this frequency range. The graph 500 indicates that the antenna module has high efficiency. Since the antenna module is part of a phased array antenna, the radiation pattern can be steered. The steering of the radiation beam can be expressed in terms of two angles, referred to as polar angle, Theta, and azimuth angle, Phi. The angle Phi can be in the plane of the phased array antenna and Theta can be an angle from the Z-axis that is perpendicular to the plane. The radiation efficiency 502 and total efficiency 504 of graph 500 is when the beamsteering is set to Theta=0° and Phi=0°.

Figure 5B:
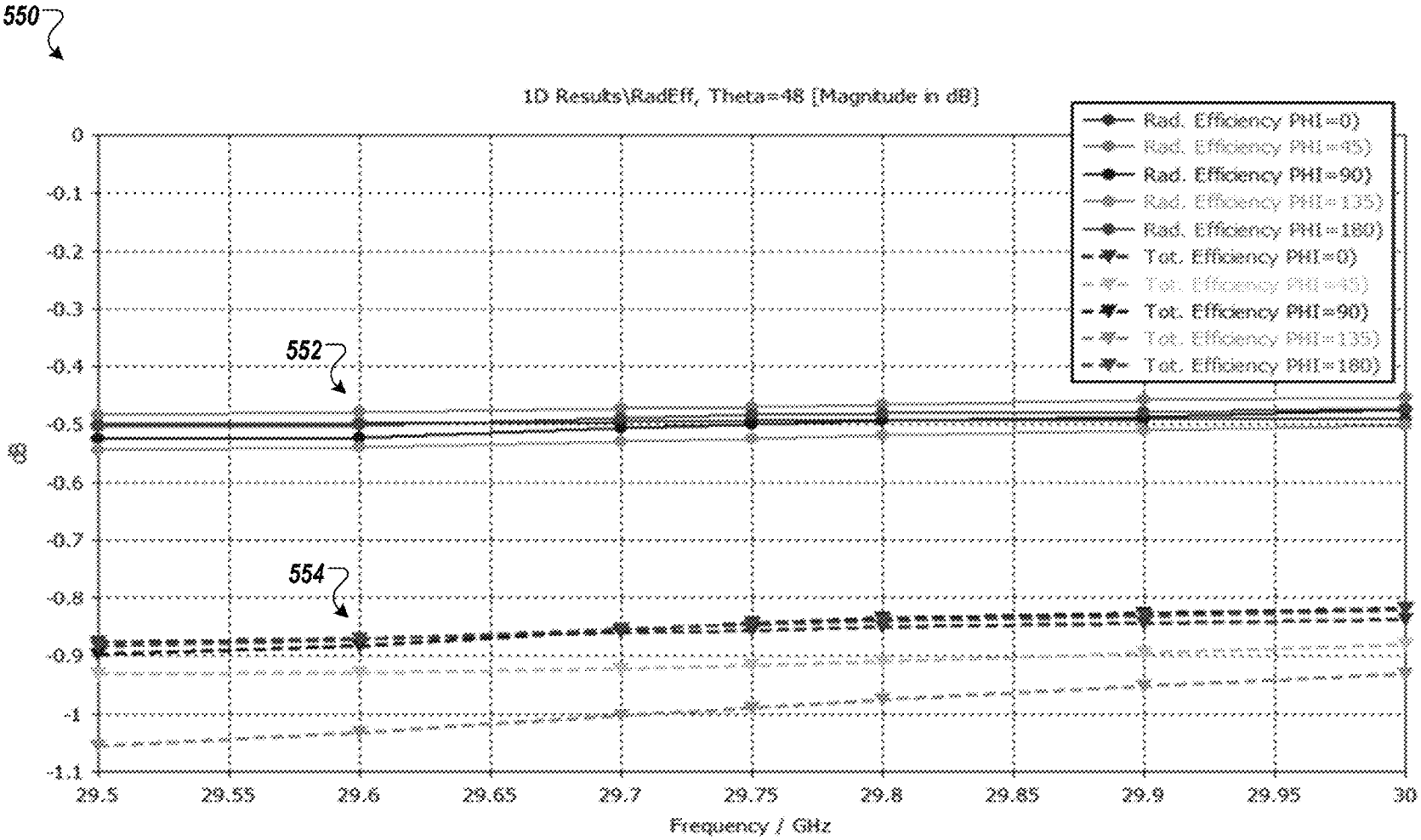
FIG. 5B is a graph of a radiation efficiency and a total efficiency of an antenna module with a rotated sub-module arrangement according to one embodiment.

FIG. 5B is a graph 550 of a radiation efficiency 552 and a total efficiency 554 of an antenna module with a rotated sub-module arrangement according to one embodiment. The graph 550 shows radiation efficiencies 552 of the antenna module for a frequency range between 29.5 GHz to 30 GHz at Theta=48° and various values for Phi, including Phi=0°, Phi=45°, Phi=90°, Phi=135°, and Phi=180°. The graph 550 also shows the total efficiency 554 of the antenna module for the frequency range between 29.5 GHz to 30 GHz at Theta=48° and various values for Phi, including Phi=0°, Phi=45°, Phi=90°, Phi=135°, and Phi=180°. The graph 550 illustrates that the antenna module is a viable antenna for this frequency range and at various Phi angles.

Figure 6:
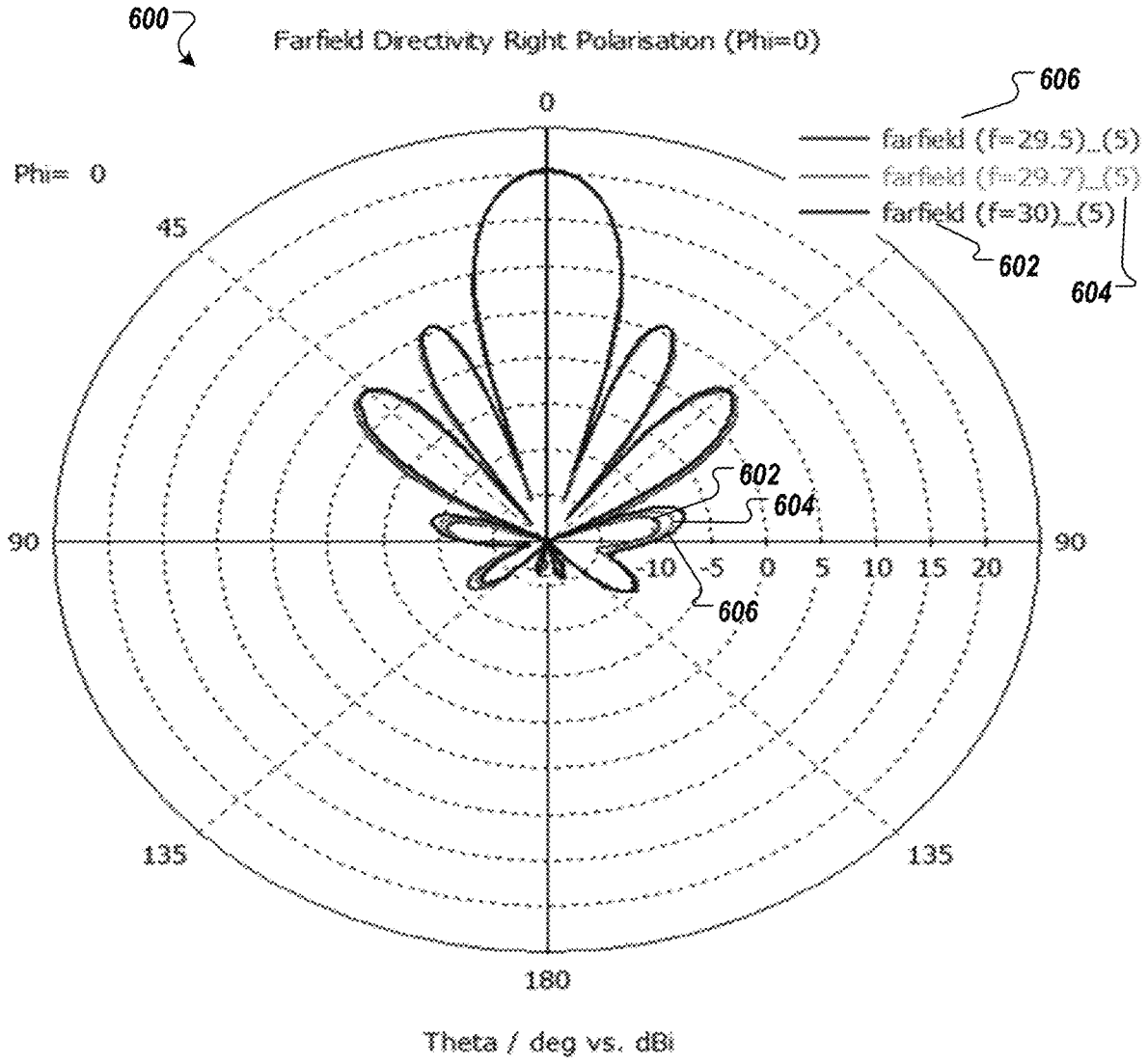
FIG. 6 is a graph of a far field directivity with right polarization of an antenna module with a rotated sub-module arrangement according to one embodiment.

FIG. 6 is a graph 600 of a far field directivity with right polarization of an antenna module with a rotated sub-module arrangement according to one embodiment. The graph 600 shows a co-polarization directivity 602 at Theta=0° and 30.0 GHz, a co-polarization directivity 604 at Theta=0° and 29.7 GHz, and co-polarization directivity 606 at Theta=0° and 30.0 GHz.

Figure 7:
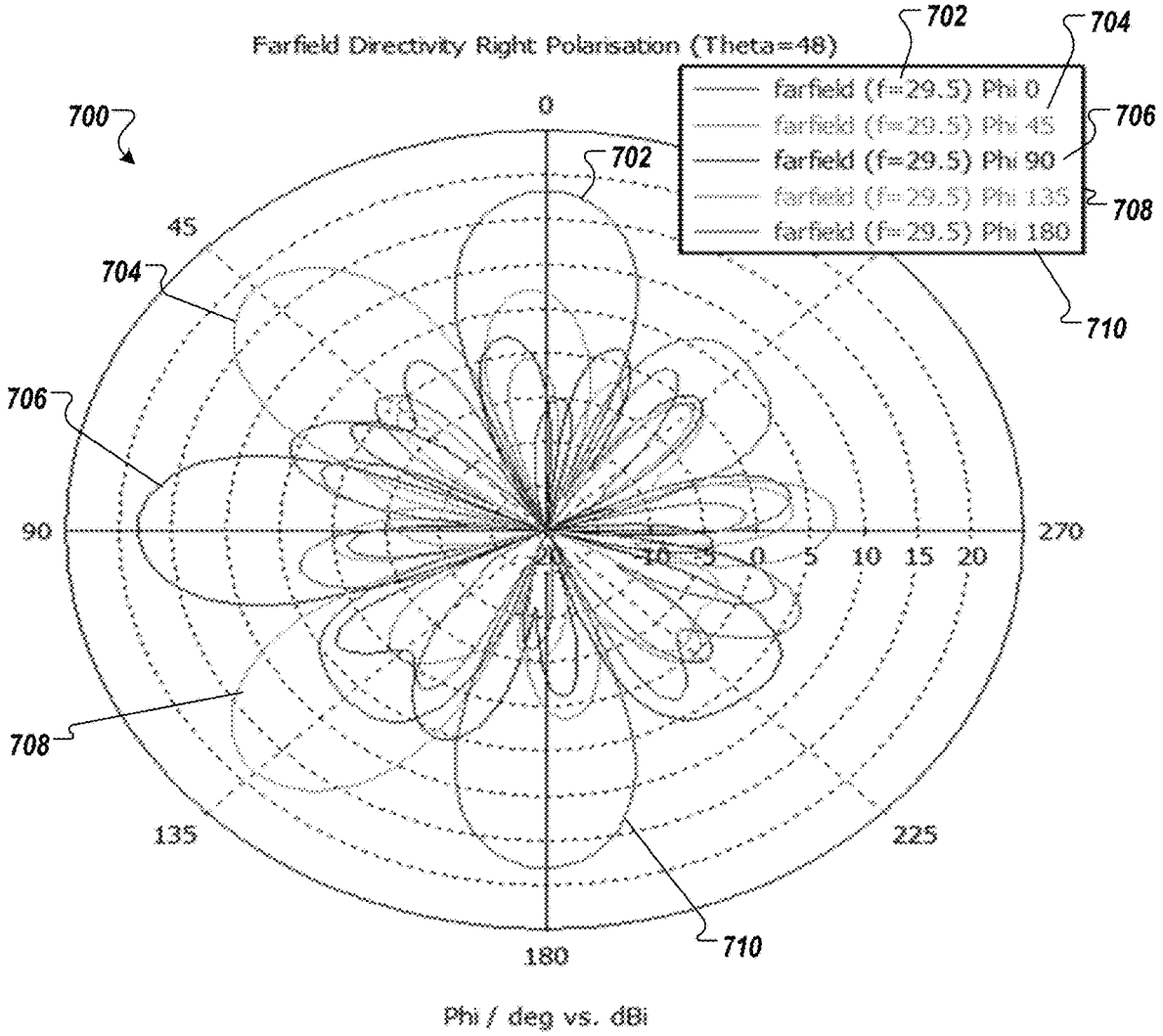
FIG. 7 is a graph of a far field directivity with right polarization of an antenna module with a rotated sub-module arrangement according to one embodiment.

FIG. 7 is a graph 700 of a far field directivity with right polarization of an antenna module with a rotated sub-module arrangement according to one embodiment. The graph 700 shows co-polarization directivities at Theta=48° and 29.5 GHz, including a co-polarization directivity 702 at Phi=0°, a co-polarization directivity 704 at Phi=45°, a co-polarization directivity 706 at Phi=90°, a co-polarization directivity 708 at Phi=135°, and a co-polarization directivity 710 at Phi=180°.

Figure 8:
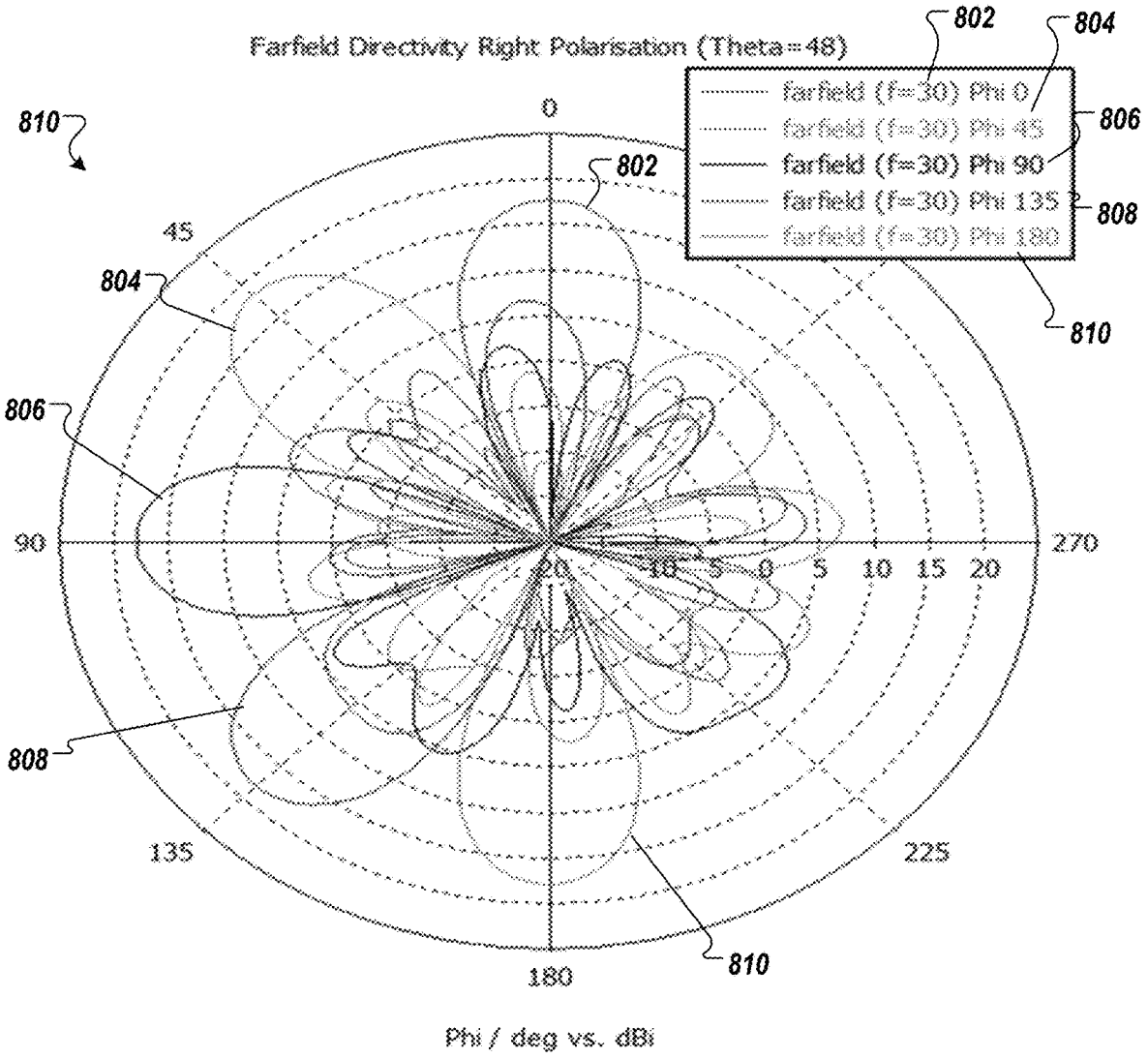
FIG. 8 is a graph of a far field directivity with right polarization of an antenna module with a rotated sub-module arrangement according to one embodiment.

FIG. 8 is a graph 800 of a far field directivity with right polarization of an antenna module with a rotated sub-module arrangement according to one embodiment. The graph 800 shows co-polarization directivities at Theta=48° and 30.0 GHz, including a co-polarization directivity 802 at Phi=0°, a co-polarization directivity 704 at Phi=45°, a co-polarization directivity 806 at Phi=90°, a co-polarization directivity 808 at Phi=135°, and a co-polarization directivity 810 at Phi=180°.

Figure 9:
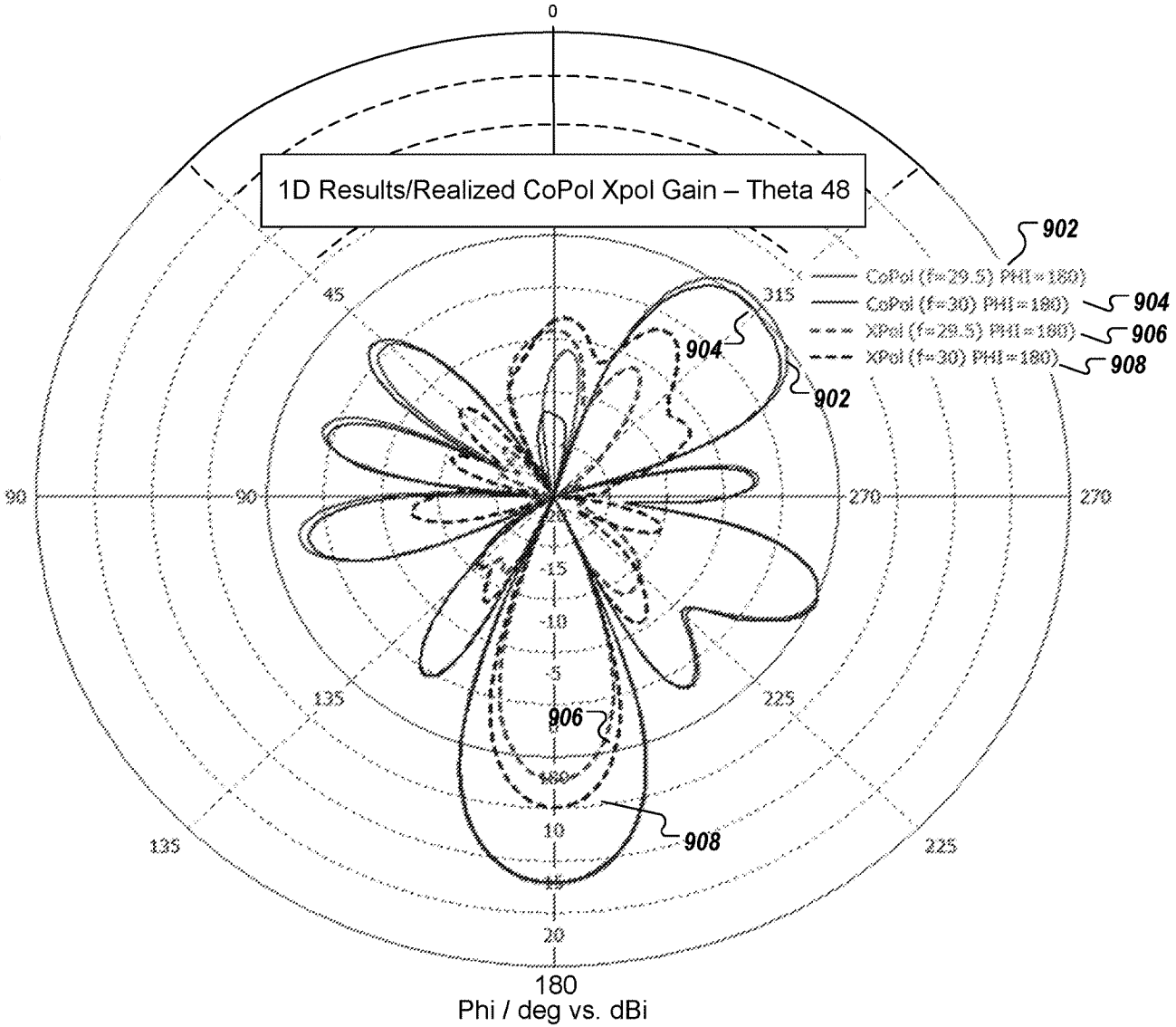
FIG. 9 is a graph of co-polarization (CoPol) versus cross polarization (XPol) realized gain of an antenna module with a rotated sub-module arrangement according to one embodiment.

FIG. 9 is a graph 900 of co-polarization (CoPol) versus cross polarization (XPol) realized gain of an antenna module with a rotated sub-module arrangement according to one embodiment. The graph 900 shows CoPol vs. XPol Realized Gain at Theta=48°, Phi=180° (worst case), and 29.5 and 30.0 GHz. The co-polarization directivity 902 is at 29.5 GHz and co-polarization directivity 904 is at 30.0 GHz. The cross-polarization directivity 906 is at 29.5 GHz and cross-polarization directivity 908 is at 30.0 GHz.

As described herein, a combined-fastener structure can be placed in the gap formed by the rotated sub-module arrangement.

Figure 10B:
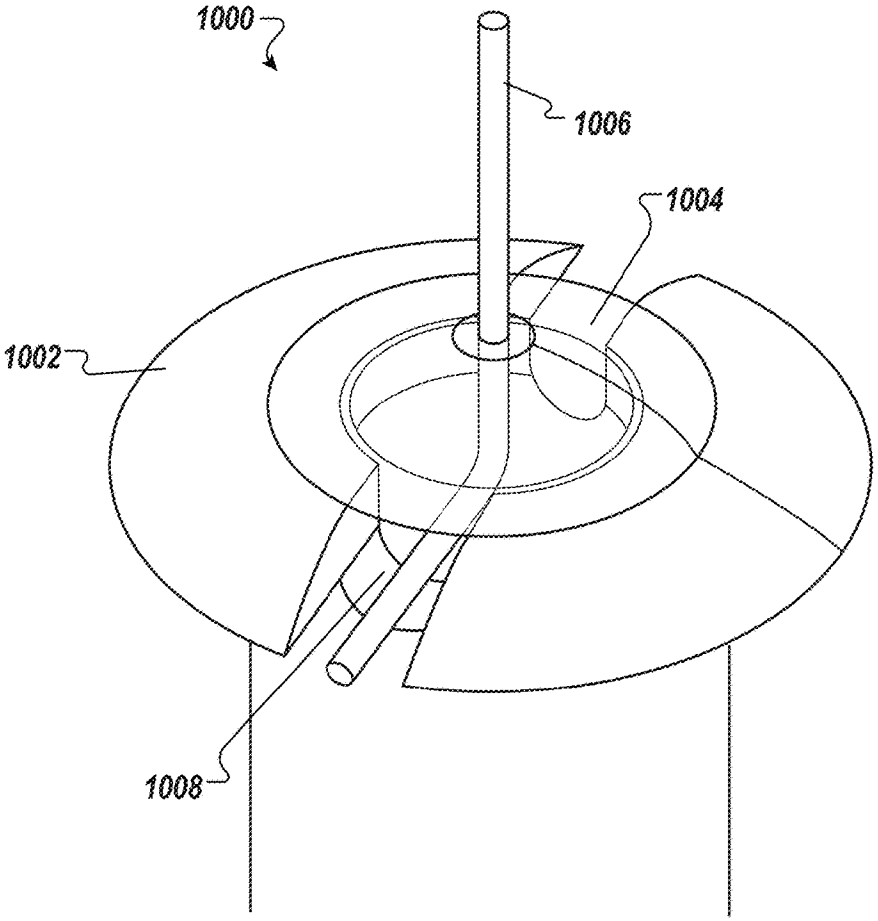
FIG. 10B illustrates a combined fastener-antenna structure in a second position according to one embodiment.
Figure 10A:
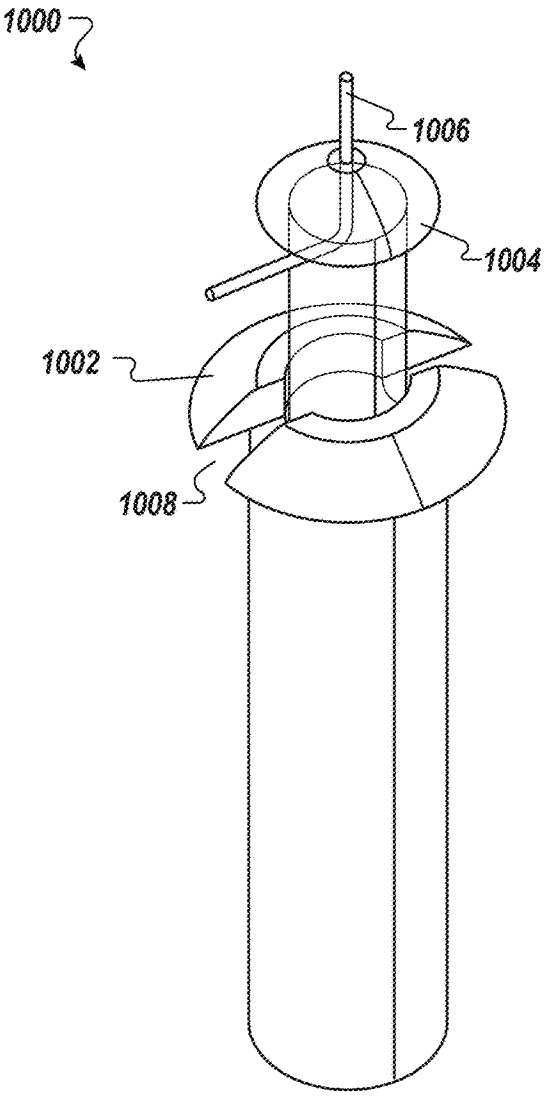
FIG. 10A illustrates a combined fastener-antenna structure in a first position according to one embodiment.

FIG. 10A illustrates a combined fastener-antenna structure 1000 in a first position according to one embodiment. The combined fastener-antenna structure 1000 is a monopole antenna fastener (MAF). The combined fastener-antenna structure 1000 serves a dual purpose, including an antenna for microwave and mmWave frequencies and the simultaneous attachment of a PWB to another object. The MAF works as a snap rivet, where there is a hollow metallic shroud 1002 that penetrates the two objects to be fastened and the hollow metallic shroud 1002 is deformed by the insertion of an insert pin 1004. The insert pin 1004 can be made of dielectric material. In one embodiment, the dielectric material can be Polyimide (e.g., DuPont Kapton® material). Alternatively, other materials can be used. The dielectric material can have low permittivity (Dk) and loss tangent (Df), yet have very high tensile strength and thermal resilience.

The insert pin 1004 incorporates an L-shaped RF pin made 1006 of a low loss, high strength metal, such as Copper Beryllium. The vertical part of the RF pin 1006 is long approximately half of the wavelength of interest and is co-linear to the insert pin 1004. The RF pin 1006 then bends horizontally at the approximate height of the head of the hollow metallic shroud 1002, where a cut 1008 has been made to let the RF pin 1006 exit the center shaft of the insert pin 1004. When the insert pin 1004 and the embedded RF pin 1006 are lowered, the RF pin 1006 contact an RF trace on the circuit board (e.g., PWB). All dimensions, including those related to the cut 1008 in the shroud head of the hollow metallic shroud 1002, are designed with the aid of design equations and electromagnetic simulation software to ensure RF matching. At the same time, the insert pin 1004 deforms to a larger diameter the lower end of the hollow metallic shroud 1002, applying radial force to the object below the PWB, fastening the device and the PWB to it.

FIG. 10B illustrates the combined fastener-antenna structure 1000 in a second position according to one embodiment. The second position is when the insert pin 1004 and the embedded RF pin 1006 are lowered in the hollow metallic shroud 1002.

In this embodiment, the embedded RF pin 1006 is a monopole antenna fastener. In other embodiments, other antenna types can be integrated into the combined fastener-antenna structure 1000, such as a dipole antenna.

In one embodiment, the monopole antenna fastener includes: a pin including a dielectric material; a hollow metallic shroud, and an L-shaped RF pin. The pin is partially disposed in the hollow metallic shroud. The hollow metallic shroud is deformed by insertion of the pin of dielectric material when lowered into the hollow metallic shroud. The L-shaped RF pin is partially embedded within the pin of dielectric material. The L-shaped RF pin includes a first portion of metal with an effective length of half wavelength and a second portion of metal that couples with an RF trace on the antenna module when inserted into the hollow metallic shroud.

In another embodiment, the combined antenna-fastener structure is a dipole antenna fastener. The dipole antenna fastener includes: a pin of dielectric material; a hollow metallic shroud that is deformed by insertion of the pin of dielectric material when lowered into the hollow metallic shroud; and two L-shaped, parallel RF pins that are partially embedded within the pin of dielectric material. Each of the two L-shaped, parallel RF pins includes a first portion of metal with an effective length of quarter wavelength and a second portion of metal that couples with an RF trace on the antenna module when inserted into the hollow metallic shroud.

Figure 11:
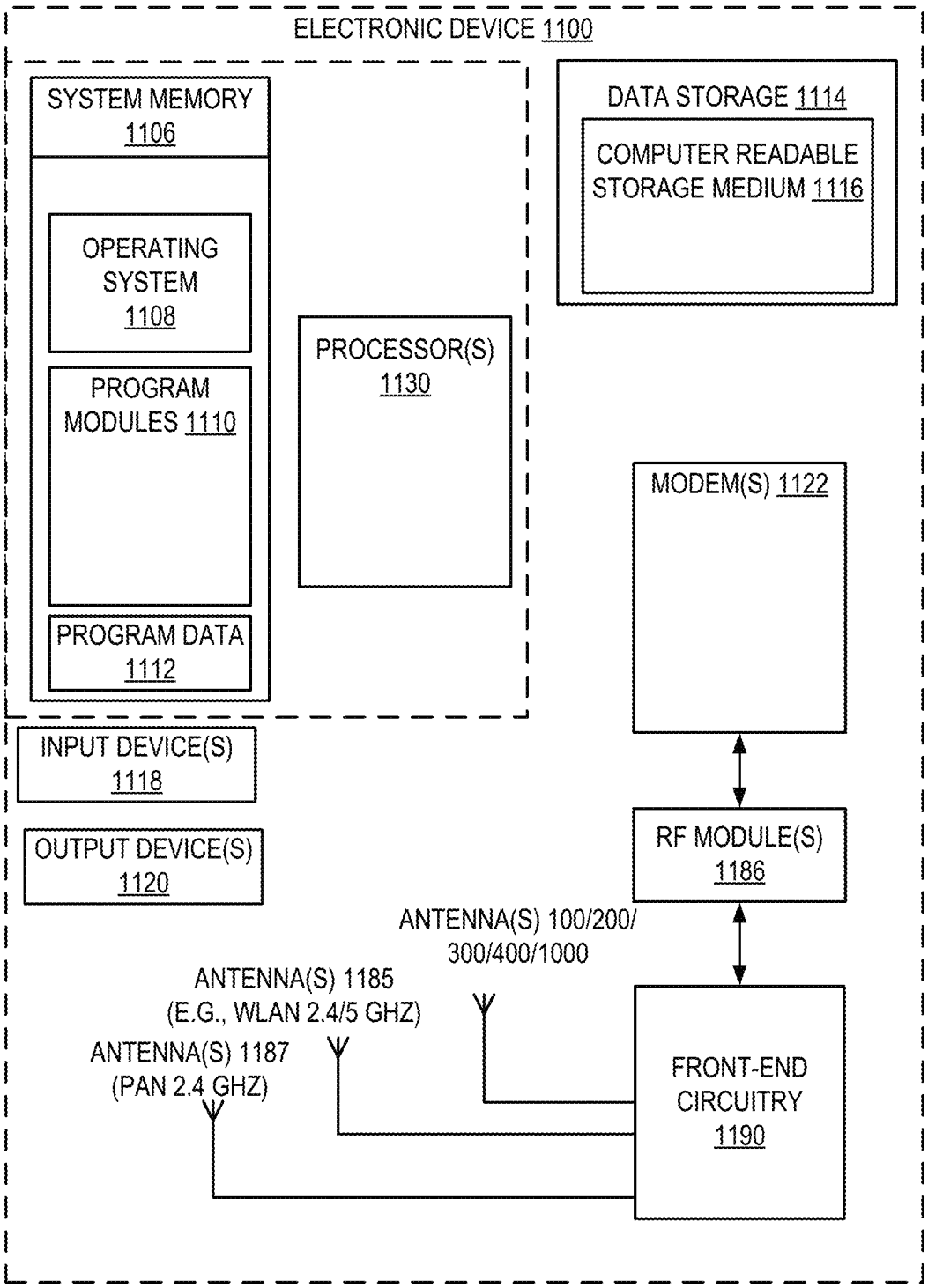
FIG. 11 is a block diagram of an electronic device that includes a rotated antenna module arrangement as described herein according to one embodiment.

FIG. 11 is a block diagram of an electronic device that includes a rotated antenna module arrangement 100, 200, 300, 400, 1000 as described herein according to one embodiment. In one embodiment, the electronic device 1100 includes the rotated antenna module arrangement of the antenna module 100 of FIGS. 1B-1C. In another embodiment, the electronic device 1100 includes the rotated antenna module arrangement of the antenna module 200 of FIG. 2A or the antenna module 250 of FIG. 2B. In another embodiment, the electronic device 1100 includes the rotated antenna module arrangement of the antenna module 300 of FIG. 3. In another embodiment, the electronic device 1100 includes the rotated antenna module arrangement of the antenna module 400 of FIG. 4. In another embodiment, the electronic device 1100 includes the rotated antenna module arrangement with the combined fastener-antenna structure 1000 of FIG. 10. Alternatively, the electronic device 1100 may be other electronic devices, as described herein.

The electronic device 1100 includes one or more processor(s) 1130, such as one or more CPUs, microcontrollers, field programmable gate arrays, or other types of processors. The electronic device 1100 also includes system memory 1106, which may correspond to any combination of volatile and/or non-volatile storage mechanisms. The system memory 1106 stores information that provides operating system component 1108, various program modules 1110, program data 1112, and/or other components. In one embodiment, the system memory 1106 stores instructions of methods to control operation of the electronic device 1100. The electronic device 1100 performs functions by using the processor(s) 1130 to execute instructions provided by the system memory 1106.

The electronic device 1100 also includes a data storage device 1114 that may be composed of one or more types of removable storage and/or one or more types of non-removable storage. The data storage device 1114 includes a computer-readable storage medium 1116 on which is stored one or more sets of instructions embodying any of the methodologies or functions described herein. Instructions for the program modules 1110 may reside, completely or at least partially, within the computer-readable storage medium 1116, system memory 1106 and/or within the processor(s) 1130 during execution thereof by the electronic device 1100, the system memory 1106 and the processor(s) 1130 also constituting computer-readable media. The electronic device 1100 may also include one or more input devices 1118 (keyboard, mouse device, specialized selection keys, etc.) and one or more output devices 1120 (displays, printers, audio output mechanisms, etc.).

The electronic device 1100 further includes a modem 1122 to allow the electronic device 1100 to communicate via a wireless connections (e.g., such as provided by the wireless communication system) with other computing devices, such as remote computers, an item providing system, and so forth. The modem 1122 can be connected to one or more radio frequency (RF) modules 1186. The RF modules 1186 may be a wireless local area network (WLAN) module, a wide area network (WAN) module, wireless personal area network (WPAN) module, Global Positioning System (GPS) module, or the like. The antenna structures (antenna(s) 100/200/250/300/400/1000, 1185, 1187) are coupled to the front-end circuitry 1190, which is coupled to the modem 1122. The front-end circuitry 1190 may include radio front-end circuitry, antenna switching circuitry, impedance matching circuitry, or the like. The antennas 100/200/250/300/400/1000 may be GPS antennas, Near-Field Communication (NFC) antennas, other WAN antennas, WLAN or PAN antennas, or the like. The modem 1122 allows the electronic device 1100 to handle both voice and non-voice communications (such as communications for text messages, multimedia messages, media downloads, web browsing, etc.) with a wireless communication system. The modem 1122 may provide network connectivity using any type of mobile network technology including, for example, Cellular Digital Packet Data (CDPD), General Packet Radio Service (GPRS), EDGE, Universal Mobile Telecommunications System (UMTS), Single-Carrier Radio Transmission Technology (1×RTT), Evaluation Data Optimized (EVDO), High-Speed Down-Link Packet Access (HSDPA), Wi-Fi®, Long Term Evolution (LTE) and LTE Advanced (sometimes generally referred to as 4G), etc.

The modem 1122 may generate signals and send these signals to antenna(s) 100/200/250/300/400/1000 of a first type (e.g., WLAN 5 GHz), antenna(s) 1185 of a second type (e.g., WLAN 2.4 GHz), and/or antenna(s) 1187 of a third type (e.g., WAN), via front-end circuitry 1190, and RF module(s) 1186 as described herein. Antennas 100/200/250/300/400/1000, 1185, 1187 may be configured to transmit in different frequency bands and/or using different wireless communication protocols. The antennas 100/200/250/300/400/1000, 1185, 1187 may be directional, omnidirectional, or non-directional antennas. In addition to sending data, antennas 100/200/250/300/400/1000, 1185, 1187 may also receive data, which is sent to appropriate RF modules connected to the antennas. One of the antennas 100/200/250/250/300/400/1000, 1185, 1187 may be any combination of the antenna structures described herein.

In one embodiment, the electronic device 1100 establishes a first connection using a first wireless communication protocol, and a second connection using a different wireless communication protocol. The first wireless connection and second wireless connection may be active concurrently, for example, if an electronic device is receiving a media item from another electronic device via the first connection) and transferring a file to another electronic device (e.g., via the second connection) at the same time. Alternatively, the two connections may be active concurrently during wireless communications with multiple devices. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna structure and the second wireless connection is associated with a second antenna.

Though a modem 1122 is shown to control transmission and reception via antenna (100/200/250300/400/1000, 1185, 1187), the electronic device 1100 may alternatively include multiple modems, each of which is configured to transmit/receive data via a different antenna and/or wireless transmission protocol.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to convey the substance of their work most effectively to others skilled in the art. An algorithm is used herein, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, Read-Only Memories (ROMs), compact disc ROMs (CD-ROMs) and magnetic-optical disks, Random Access Memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present embodiments as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. A wireless device comprising:

a radio comprising a baseband processor and radio frequency front-end (RFFE) circuitry;

an antenna array coupled to the RFFE circuitry, the antenna array comprising:

a circuit board;

a first antenna module coupled to the circuit board, the first antenna module comprising a first plurality of antenna elements, the first antenna module having a rectangle shape;

a second antenna module coupled to the circuit board, the second antenna module comprising a second plurality of antenna elements, the second antenna module having the rectangle shape;

a third antenna module coupled to the circuit board, the third antenna module comprising a third plurality of antenna elements, the third antenna module having the rectangle shape; and a fourth antenna module coupled to the circuit board, the fourth antenna module comprising a fourth plurality of antenna elements, the fourth antenna module having the rectangle shape, wherein:

the second antenna module is disposed adjacent to the first antenna module, the second antenna module being rotated 90 degrees from the first antenna module such that a first long side of the second antenna module is aligned with a first short side of the first antenna module;

the third antenna module is disposed adjacent to the second antenna module, the third antenna module being rotated 90 degrees from the second antenna module such that a first long side of the third antenna module is aligned with a first short side of the second antenna module; and the fourth antenna module is disposed adjacent to the third antenna module, the fourth antenna module being rotated 90 degrees from the third antenna module such that i) a first long side of the fourth antenna module is aligned with a first short side of the third antenna module, ii) a first short side of the fourth antenna module is aligned with a first long side of the first antenna module, and iii) a second long side of the fourth antenna module is adjacent to a second short side of the first antenna module; and at least one of a calibration antenna or a fastener located between a portion of the second long side of the first antenna module, a portion of a second long side of the second antenna module, a portion of a second long side of the third antenna module, and a portion of a second long side of the fourth antenna module.

2. The wireless device of claim 1, wherein the first antenna module, the second antenna module, the third antenna module, and the fourth antenna module are identical modules, wherein the first plurality of antenna elements is arranged in a grid pattern, wherein the grid pattern comprises n/2 antenna elements by n/2+1 antenna elements, where n is a positive, even integer that is equal to or greater than two.

3. The wireless device of claim 1, wherein:

the first antenna module, the second antenna module, the third antenna module, and the fourth antenna module are identical modules;

the first plurality of antenna elements is arranged in a first number of rows and a second number of columns, the first number being greater than the second number; and only one element in each of the columns is terminated with a matched load and only one of the rows has no elements that are terminated with the matched load.

4. A phased array antenna structure comprising:

a support structure; and an antenna module coupled to the support structure, the antenna module having a first even number of antenna elements and a second even number of antenna elements, wherein each of the second even number of antenna elements is terminated to a load, wherein the second even number is n/2, where n is a positive integer that is equal to or greater than two and is equal to the square root of the first even number, wherein:

the antenna module comprises a plurality of sub-modules each having a rectangular lattice with $$\frac{n}{2} \times \frac{n}{2} + 1$$

rectangular pattern; and the plurality of sub-modules are arranged such that the plurality of sub-modules together defines a gap at a center of the antenna module; and a calibration antenna located in the gap formed between the plurality of sub-modules.

5. The phased array antenna structure of claim 4, wherein the antenna module comprises a first inter-element spacing between antenna elements, the inter-element spacing being less than a second inter-element spacing of an antenna module having a square lattice with a n×n square pattern, wherein the first inter-element spacing is reduced by a factor of $$\frac{n+1}{n}$$

from the second inter-element spacing.

6. The phased array antenna structure of claim 4, further comprising a second antenna module that is identical to the antenna module, wherein the second antenna module is disposed adjacent to the antenna module.

7. The phased array antenna structure of claim 4, wherein each of the plurality of sub-modules is an identical manufactured part, wherein the plurality of sub-modules comprises:

a first sub-module comprising a first plurality of antenna elements, the first sub-module having a rectangle shape;

a second sub-module comprising a second plurality of antenna elements, the second sub-module having the rectangle shape;

a third sub-module comprising a third plurality of antenna elements, the third sub-module having the rectangle shape; and a fourth sub-module comprising a fourth plurality of antenna elements, the fourth sub-module having the rectangle shape, wherein:

the second sub-module is disposed adjacent to the first sub-module, the second sub-module being rotated 90 degrees from the first sub-module such that a first long side of the second sub-module is aligned with a first short side of the first sub-module;

the third sub-module is disposed adjacent to the second sub-module, the third sub-module being rotated 90 degrees from the second sub-module such that a first long side of the third sub-module is aligned with a first short side of the second sub-module; and the fourth sub-module is disposed adjacent to the third sub-module, the fourth sub-module being rotated 90 degrees from the third sub-module such that i) a first long side of the fourth sub-module is aligned with a first short side of the third sub-module, ii) a first short side of the fourth sub-module is aligned with a first long side of the first sub-module, and iii) a second long side of the fourth sub-module is adjacent to a second short side of the first sub-module.

8. The phased array antenna structure of claim 7, wherein the first sub-module, the second sub-module, the third sub-module, and the fourth sub-module are identical, wherein the first plurality of antenna elements is arranged in a grid pattern, wherein the grid pattern comprises n/2 antenna elements by n/2+1 antenna elements, where n is a positive, even integer that is equal to or greater than two.

9. The phased array antenna structure of claim 7, wherein:

the first sub-module, the second sub-module, the third sub-module, and the fourth sub-module are identical;

the first plurality of antenna elements is arranged in a third number of rows and a fourth number of columns, the third number being greater than the fourth number; and only one element in each of the columns is terminated with the load and only one of the rows has no elements that are terminated with the load.

10. The phased array antenna structure of claim 4, wherein the calibration antenna comprises a combined antenna-fastener structure, wherein the combined antenna-fastener structure comprises a monopole antenna fastener comprising:

a pin comprising a dielectric material;

a hollow metallic shroud, wherein the pin is partially disposed in the hollow metallic shroud; and an L-shaped radio frequency (RF) pin that is partially embedded within the pin, wherein the L-shaped RF pin includes a first portion of metal with an effective length of half wavelength and a second portion of metal that couples with an RF trace on the antenna module.

11. The phased array antenna structure of claim 4, wherein the calibration antenna comprises a combined antenna-fastener structure, wherein the combined antenna-fastener structure comprises a dipole antenna fastener comprising:

a pin comprising a dielectric material;

a hollow metallic shroud that is deformed by insertion of the pin of dielectric material when lowered into the hollow metallic shroud; and two L-shaped, parallel radio frequency (RF) pins that are partially embedded within the pin of dielectric material, wherein each of the two L-shaped, parallel RF pins includes a first portion of metal with an effective length of quarter wavelength and a second portion of metal that couples with an RF trace on the antenna module when inserted into the hollow metallic shroud.

12. The phased array antenna structure of claim 4, wherein each of the antenna elements of the antenna module is a patch antenna element.

13. A wireless device comprising:

a radio comprising a baseband processor and radio frequency front-end (RFFE) circuitry; and an antenna module coupled to the RFFE circuitry, the antenna module comprising a first even number of antenna elements and a second even number of antenna elements, and the antenna module comprising a substrate, wherein:

each antenna element of the second even number of antenna elements is terminated to a load;

the second even number is n/2, where n is a positive integer that is equal to or greater than two and is equal to the square root of the first even number;

the antenna module comprises a plurality of sub-modules arranged such that the plurality of sub-modules together define an opening to an area on the substrate located between the plurality of sub-modules; and the plurality of sub-modules are separate articles of manufacture and are attached to the substrate; and at least one of a calibration antenna or a fastener located in the opening to the area on the substrate located between the plurality of sub-modules.

14. The wireless device of claim 13, further comprising:

a second radio, wherein-the at least one of the calibration antenna or the fastener comprises an antenna fastener coupled to the second radio, wherein the antenna fastener is disposed in the opening to the area on the substrate.

15. The wireless device of claim 13, wherein the plurality of sub-modules comprises:

a first sub-module comprising a first plurality of antenna elements organized in a first rectangular lattice;

a second sub-module comprising a second plurality of antenna elements organized in a second rectangular lattice, the second rectangular lattice being adjacent to the first rectangular lattice and rotated 90 degrees from the first rectangular lattice such that a first long side of the second rectangular lattice is aligned with a first short side of the first rectangular lattice;

a third sub-module comprising a third plurality of antenna elements organized in a third rectangular lattice, the third rectangular lattice being adjacent to the second rectangular lattice and rotated 90 degrees from the second rectangular lattice such that a first long side of the third rectangular lattice is aligned with a first short side of the second rectangular lattice; and a fourth sub-module comprising a fourth plurality of antenna elements organized in a fourth rectangular lattice, the fourth rectangular lattice being adjacent to the third rectangular lattice and rotated 90 degrees from the third rectangular lattice such that a first long side of the fourth rectangular lattice is aligned with a first short side of the third rectangular lattice, wherein the first sub-module, the second sub-module, the third sub-module, and the fourth sub-module are arranged such that first sub-module, the second sub-module, the third sub-module, and the fourth sub-module define the opening to the area on the substrate.

16. The wireless device of claim 15, wherein the fourth rectangular lattice is disposed such that a first short side of the fourth rectangular lattice is aligned with a first long side of the first rectangular lattice and a second long side of the fourth rectangular lattice is adjacent to a second short side of the first rectangular lattice.

17. The wireless device of claim 15, wherein the first sub-module, the second sub-module, the third sub-module, and the fourth sub-module are identical, wherein the first plurality of antenna elements is arranged in a grid pattern, wherein the grid pattern comprises n/2 antenna elements by n/2+1 antenna elements, where n is a positive, even integer that is equal to or greater than two.

18. The wireless device of claim 15, wherein:

the first sub-module, the second sub-module, the third sub-module, and the fourth sub-module are identical;

the first plurality of antenna elements is arranged in a third number of rows and a fourth number of columns, the third number being greater than the fourth number; and only one element in each of the columns is terminated with the load and only one of the rows has no elements that are terminated with the load.

19. The wireless device of claim 15, wherein the at least one of the calibration antenna or the fastener comprises a monopole antenna fastener comprising:

a pin of dielectric material;

a hollow metallic shroud that is deformed by insertion of the pin of dielectric material when lowered into the hollow metallic shroud; and an L-shaped radio frequency (RF) pin that is partially embedded within the pin of dielectric material, wherein the L-shaped RF pin includes a first portion of metal with an effective length of half wavelength and a second portion of metal that couples with an RF trace on the antenna module when inserted into the hollow metallic shroud.

20. The wireless device of claim 15, wherein the at least one of the calibration antenna or the fastener comprises a dipole antenna fastener comprising:

a pin of dielectric material;

a hollow metallic shroud that is deformed by insertion of the pin of dielectric material when lowered into the hollow metallic shroud; and two L-shaped, parallel radio frequency (RF) pins that are partially embedded within the pin of dielectric material, wherein each of the two L-shaped, parallel RF pins includes a first portion of metal with an effective length of quarter wavelength and a second portion of metal that couples with an RF trace on the antenna module when inserted into the hollow metallic shroud.

* * * * *